US006324812B1

(12) United States Patent
Drya-Lisiecka

(10) Patent No.: US 6,324,812 B1
(45) Date of Patent: Dec. 4, 2001

(54) METHOD AND KIT FOR MONOLITHIC CONSTRUCTION OF METAL FIBER REINFORCED CONCRETE FORMED BY CORRUGATED FOAM PANELS

(75) Inventor: Krystina Drya-Lisiecka, Montreal (CA)

(73) Assignee: 3417191 Canada Inc., Quebec (CA)

( * ) Notice: Subject to any disclaimer, the term of this patent is extended or adjusted under 35 U.S.C. 154(b) by 0 days.

(21) Appl. No.: 09/612,180

(22) Filed: Jul. 7, 2000

(30) Foreign Application Priority Data

Jul. 9, 1999 (CA) ..... 2277689

(51) Int. Cl.[7] ..... E04C 2/32

(52) U.S. Cl. ..... 52/783.11; 52/309.12; 52/742.14; 52/272

(58) Field of Search ..... 52/272, 275, 425, 52/309.12, 309.17, 378, 783.11, 798.1, 745.05, 745.09, 745.1, 742.14; 249/4, 19, 35, 188, 189, 193

(56) References Cited

U.S. PATENT DOCUMENTS

| | | | |
|---|---|---|---|
| 1,373,523 | 4/1921 | Nicholas | 52/319 |
| 2,272,659 | 2/1942 | Daley | 25/131 |
| 2,405,116 | 8/1946 | Cullen | 72/1 |
| 2,523,713 | 9/1950 | Mortrude, Jr. | 25/131 |
| 3,664,630 | 5/1972 | Maynen et al. | 249/112 |
| 4,998,393 * | 3/1991 | Baena | 52/236.9 |
| 5,491,947 | 2/1996 | Kim | 52/426 |
| 5,551,204 | 9/1996 | Mayrand | 52/795.1 |
| 5,678,384 * | 10/1997 | Maze | 52/783.17 |

FOREIGN PATENT DOCUMENTS

| | | | |
|---|---|---|---|
| 75941 | 10/1917 | (CH) | 25/131 |
| 0546847 | 6/1993 | (EP) | E04B/1/16 |
| 2161407 | 7/1973 | (FR) | 25/131 |
| 420596 | 4/1947 | (IT) | 25/131 |
| WO 9743507 | 11/1997 | (WO) | 25/131 |

* cited by examiner

*Primary Examiner*—Carl D. Friedman
*Assistant Examiner*—Naoko Slack
(74) *Attorney, Agent, or Firm*—Darby & Darby

(57) ABSTRACT

A monolithic construction of concrete reinforced with dispersed metal fibers having a bottom wall spaced from a top wall with each of the top and bottom walls having a top face generally parallel to an under face having a generally corrugated relief with alternating recesses and ridges extending in a substantially horizontal direction. A plurality of sidewalls extend upwardly from the bottom wall to the top wall and each sidewall has a generally overall corrugated cross section. An insulating foam panel covers the under face of each of the top wall and the bottom wall and there is a set of insulating foam panels between which each of the sidewalls is sandwiched, the insulating foam panels being the concrete formwork of the concrete structure.

12 Claims, 12 Drawing Sheets

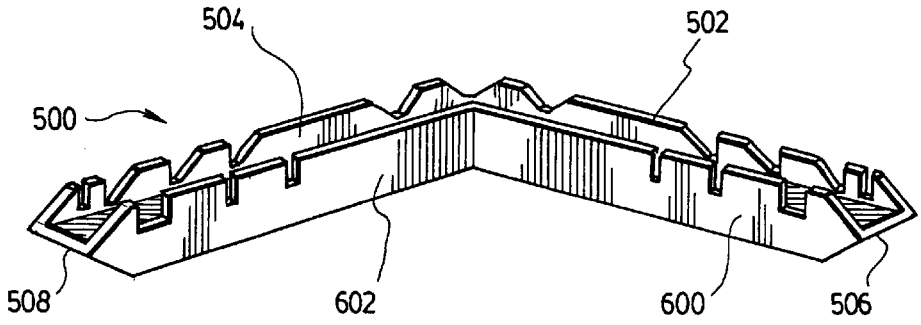
FIG. 14
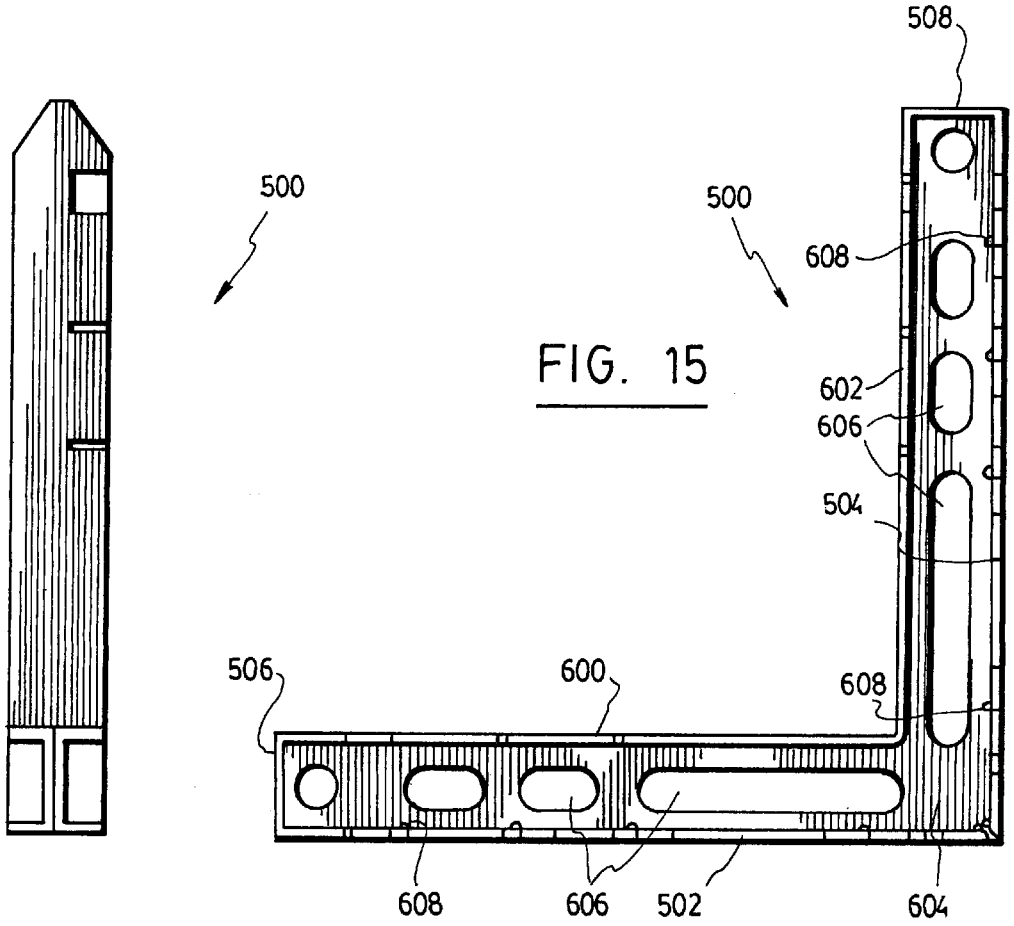
FIG. 15
FIG. 16

METHOD AND KIT FOR MONOLITHIC CONSTRUCTION OF METAL FIBER REINFORCED CONCRETE FORMED BY CORRUGATED FOAM PANELS

FIELD OF THE INVENTION

The present invention relates generally to concrete construction and form systems for concrete construction. More particularly, it concerns a monolithic paraseismic concrete construction.

BACKGROUND

The use of concrete forms for the moulding of a concrete wall is well known in the art and widely practised. Conventional concrete forms are made by securing either panelling such as plywood or individual boards to reinforcing studs. The individual forms are placed in the desired position and after the concrete is set, the forms are removed. The use of these forms is expensive, since reuse of the lumber is limited and a substantial amount of labour is required to build the forms.

One of the considerations involved in the pouring of concrete walls is the strength of the wall which is required for the building. Thus, the tensile strength and compressive strength are properties which must be taken into consideration in designing the concrete wall. Factors which are involved in determining the final properties include the type of concrete mix and the thickness of the wall. Naturally, one can increase some of the strength properties by pouring thicker walls; this will however increase the cost. Naturally, it is desirable to use as little concrete as possible to achieve the required properties.

Prior patent application no WO97/43507 in the name of the applicant discloses a concrete wall with an overall corrugated configuration. This wall, which requires a lot less concrete mixture to make than a conventional planar concrete wall, shows much better final properties than the latter.

Other examples of concrete walls of different shapes known in the prior art are given in the following patent documents: U.S. Pat. Nos. 1,373,523; 2,272,659; 2,523,713; 3,664,630; 5,491,947; FR 2,161,407; SW 75,941; IT 420, 596.

Although, some of these above-mentioned prior art documents may disclose concrete walls having relatively good properties, none of those documents discloses or suggests a whole construction that would have excellent paraseismic properties, neither a simple and inexpensive way to build such paraseismic construction.

Also, many difficulties are encountered in the making of high-performance, paraseismic ecological structures. Among those, there are the following: the unevenness and geological quality of the soil, the flooding, and thawing and freezing cycles are factors which increase the construction costs and accelerate the degradation of the buildings; the poor quality of the cement; the high cost of steel framework; the lack of qualified workers in certain countries; the necessity of reducing sophisticated tools such as mechanical crane; the lack of substructure and of means of transport; the lack of electrical energy in certain regions; problems related to transportation of prefabricated elements or houses; and the necessity of using materials other than wood which could be very costly and which generally has a poor resistance to termites, mushrooms, humidity, fire and earthquakes.

There is thus presently for a wind proof paraseismic technology, and a necessity of developing a global technology using the same material other than wood for the floor, the walls and the ceiling of a construction.

SUMMARY OF THE INVENTION

It is an object of the present invention to provide a concrete construction that will satisfy this need and will overcome many of these above-mentioned difficulties.

It is a further object of the present invention to provide a concrete form system which is easy to assemble and use.

It is also an object of the present invention to provide a method for forming a concrete construction wherein the use of concrete is minimized.

In accordance with the present invention, some of these objects are achieved with a concrete construction comprising:

a bottom wall;

a plurality of sidewalls extending upright from the bottom wall, each sidewall being made of concrete and having a generally overall corrugated cross section with alternating recesses and ridges extending in a substantially vertical direction; and a top wall intersecting the sidewalls at upper edges thereof, the top wall being made of concrete and having a top face generally parallel to an under face, the under face having a generally corrugated relief with alternating recesses and ridges extending in a substantially horizontal direction.

Preferably, the bottom wall is made of concrete with a top face generally parallel to an under face, the under face having a generally corrugated relief with alternating recesses and ridges extending in a substantially horizontal direction.

The present invention also proposes a kit of modular foam panels used to make a construction as described hereinabove. The kit comprises:

a) a plurality of corrugated foam panels having a generally rectangular shape outlined by a first pair of opposite corrugated side edges and a second pair of opposite linear side edges and a generally corrugated relief with alternating recesses and ridges extending in a longitudinal direction between the two corrugated side edges, said recesses and ridges having a semi hexagonal shape with two tapering segments and a third segment interconnecting a thinner end of the two tapering segments;

b) at least two comer foam panels of a first type each including:

a linear first edge opposite a corrugated second edge with alternating recesses and ridges matching the corrugated side edges of the corrugated foam panels, the linear first edge and the corrugated second edge extending in substantially parallel planes, said recesses and ridges having a semi hexagonal shape with two tapering segments and a third segment interconnecting a thinner end of the two tapering segments;

substantially planar wall sections extending perpendicularly to the parallel planes of the first and second edges between the ridges of the second edge and segments of the first edge; and polyhedron wall sections extending between the recesses of the second edge and segments of the first edge; and c) at least two comer foam panels of a second type each including:

a corrugated first edge matching with the corrugated side edges of the corrugated foam panel and having alternating recesses and ridges extending in a first plane, the recesses having a semi hexagonal shape with two tapering segments and a third segment interconnecting a thinner end of said two tapering segments;

a corrugated second edge having alternating recesses and ridges matching with the corrugated side edges of the corrugated foam panel and extending in a second plane substantially perpendicular to the first plane, the recesses having a semi hexagonal shape defined by two tapering segments and a third segment interconnecting a thinner end of said two tapering segments;

substantially planar wall sections extending in the first plane between the ridges of the first and second edge; and polyhedron wall sections extending between the recesses of the first and second edge.

In a further aspect of the present invention, there is provided a method of making a concrete construction as described hereinabove, comprising the steps of:

a) providing a kit of foam panels as defined above;

b) preparing concrete beams that will be used later on to construct a top wall of the construction, comprising setting one of the corrugated foam panels on a planar surface with the longitudinal direction extending parallel to the planar surface and pouring a concrete slurry only in the recesses of said corrugated foam panel so to form a plurality of parallel concrete beams;

c) erecting the sidewalls of the construction comprising the steps of:

setting, wall forms for forming the sidewalls of the construction, each of the wall forms comprising a pair of the corrugated foam panels with their longitudinal direction set to extend in a substantially vertical direction, the pair of panels defining a cavity therebetween with a corrugated configuration, one of the corrugated foam panels being designated as an outside foam panel and the other one being designated as an inside foam panel, the wall forms being disposed to form a rectangular construction including two pairs of opposite sidewalls;

pouring a concrete slurry in the cavity of each wall form; and d) while the concrete slurry poured in step c) is not completely solidified, making a top wall of the construction, comprising:

setting on top of two of the wall forms set in step c) and which are opposite to each other, a comer form for forming a comer between a sidewall and the top wall, the comer form including a corrugated foam panel facing a comer foam panel of the first type to define a cavity therebetween, the corrugated foam panel being set on top of the outside corrugated foam panel set in step c) and the comer foam panel being set on top of the inside corrugated foam panel set in step c) with its corrugated second edge facing downwards, setting on each of the other two wall forms set in step c) a corner form including a corrugated foam panel facing a corner foam panel of the second type to define a cavity therebetween, the corrugated foam panel of the corner form being set on top of the outside corrugated foam panel set in step c) and the corner foam panel of the second type being set on top of the inside corrugated foam panel with its corrugated second edge facing downwards;

mounting, over the corner forms, the concrete beams with the corrugated foam panel prepared in step b) such that each of the two corrugated side edges of the corrugated foam panel bearing the beams is laid down on the first edge of a corresponding comer foam panel of the second type and that each of the two linear side edges of the corrugated foam panel is laid down on the linear first edge of a corresponding comer foam panel of the first type;

pouring a concrete slurry in the cavity of each of the corner forms and on the corrugated foam panel of step b) so to form a top wall with a planar top face opposite a corrugated under face and monolithic concrete corners between the sidewalls and the top wall.

Therefore, as can be appreciated, and based on the above-mentioned observations, a monolithic concrete construction using modular permanent insulating forms for pouring the concrete has been developed. This construction is characterized in that it is an overall shell-like monolithic construction with an overall generally corrugated configuration. By monolithic construction, it is meant a single solid construction. The overall corrugated configuration of the walls, the ceiling and the floor allows the thickness of the walls to be greatly reduced without reducing the strength of the construction. On the contrary this configuration allows an increase in the strength of the building while at the same time allowing a great reduction of the weight thereof and an increase in the moment of inertia.

In practice, this results in a reduction of the thickness of the foundation walls to 6 cm which entails an economy of 60% of concrete.

The main goal of the project was to develop the optimal construction which would guaranty a maximum stability with respect to the uneven movements of the soil and perfect resistance to seismic charges and raging winds. It is thus important to control the weight, the geometry and the global strength of the building and the quality of the material used. Finally, the corrugated shape obtained by using a plurality of particular similar modular forms was chosen. These forms, which have a generally U shape with two arms, are disposed one after the other in a line to thereby create an overall corrugated shape. The distance between these forms, the thickness of the walls, the choice between straight and corrugated forms can be varied as much as needed so to obtain many different constructions and that, according to the specific needs. Thanks to this wide variety of solutions, it is possible to chose the maximal moment of inertia while at the same time reducing the overall weight of the construction.

Other features and objects of the present invention will become more apparent from the description that follows of a preferred embodiment, having reference to the appended drawings and given as an example only, as to how the invention may be put into practice.

DESCRIPTION OF THE FIGURES

FIG. 14 is a perspective view of a comer base element;

FIG. 15 is a top plan view thereof;

FIG. 16 is a side elevational view thereof;

DESCRIPTION OF A PREFERRED EMBODIMENT

Figure 2:
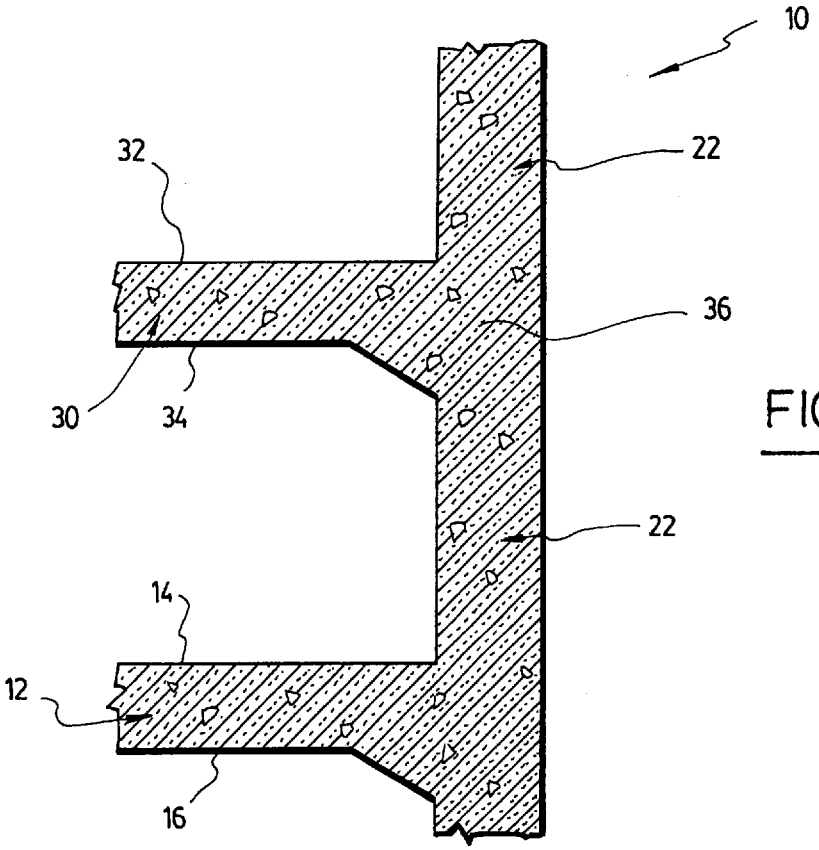
FIG. 2 is a cross-sectional view taken along line III—III of FIG. 1 showing more particularly an angled comer obtained under a top wall.
Figure 3:
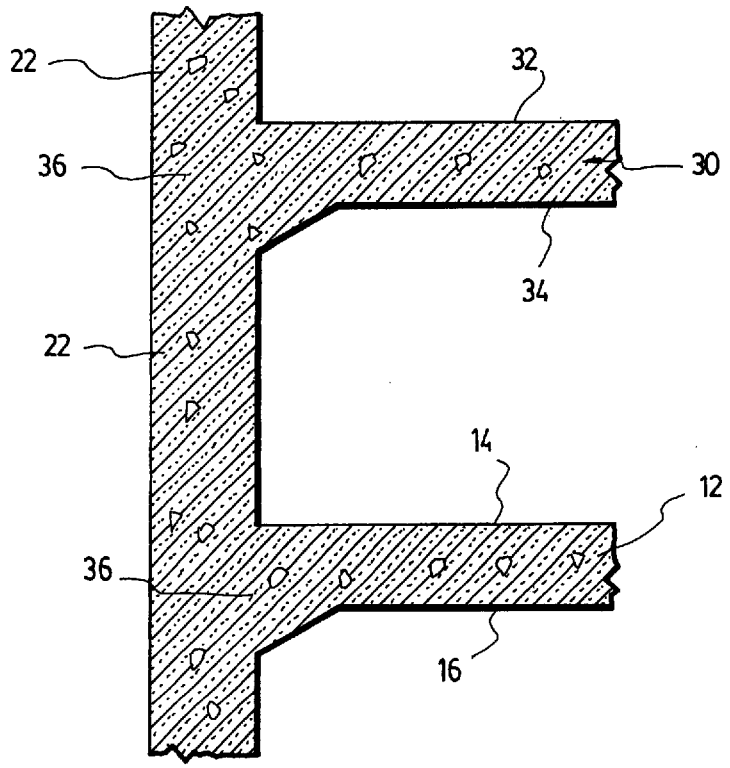
FIG. 3 is a cross-sectional view taken along line IV—IV of FIG. 1 showing another angled corner obtained under a top wail.

Referring to FIG. 2, a paraseismic construction (10) according to the invention can be a multi-storey building. The storeys can have a uniform height throughout the building, or the height of each storey could vary. As will be more apparent upon reading the following description, the construction is a paraseismic monolithic construction meaning that once erected it forms a massive, solid and uniform whole.

Figure 1:
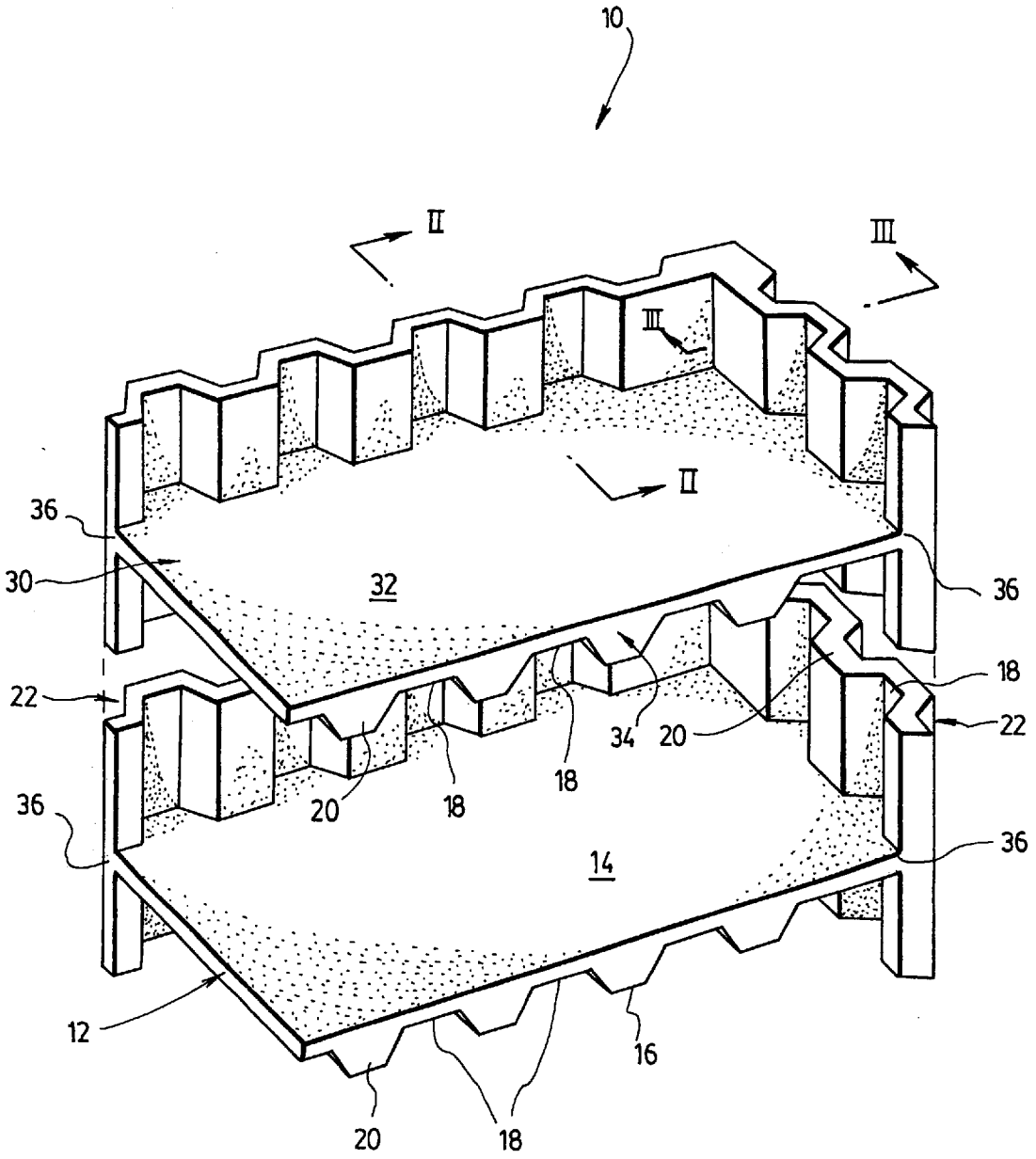
FIG. 1 is a fragmentary perspective view of a paraseismic construction according to a preferred embodiment of the invention.
Figure 7:
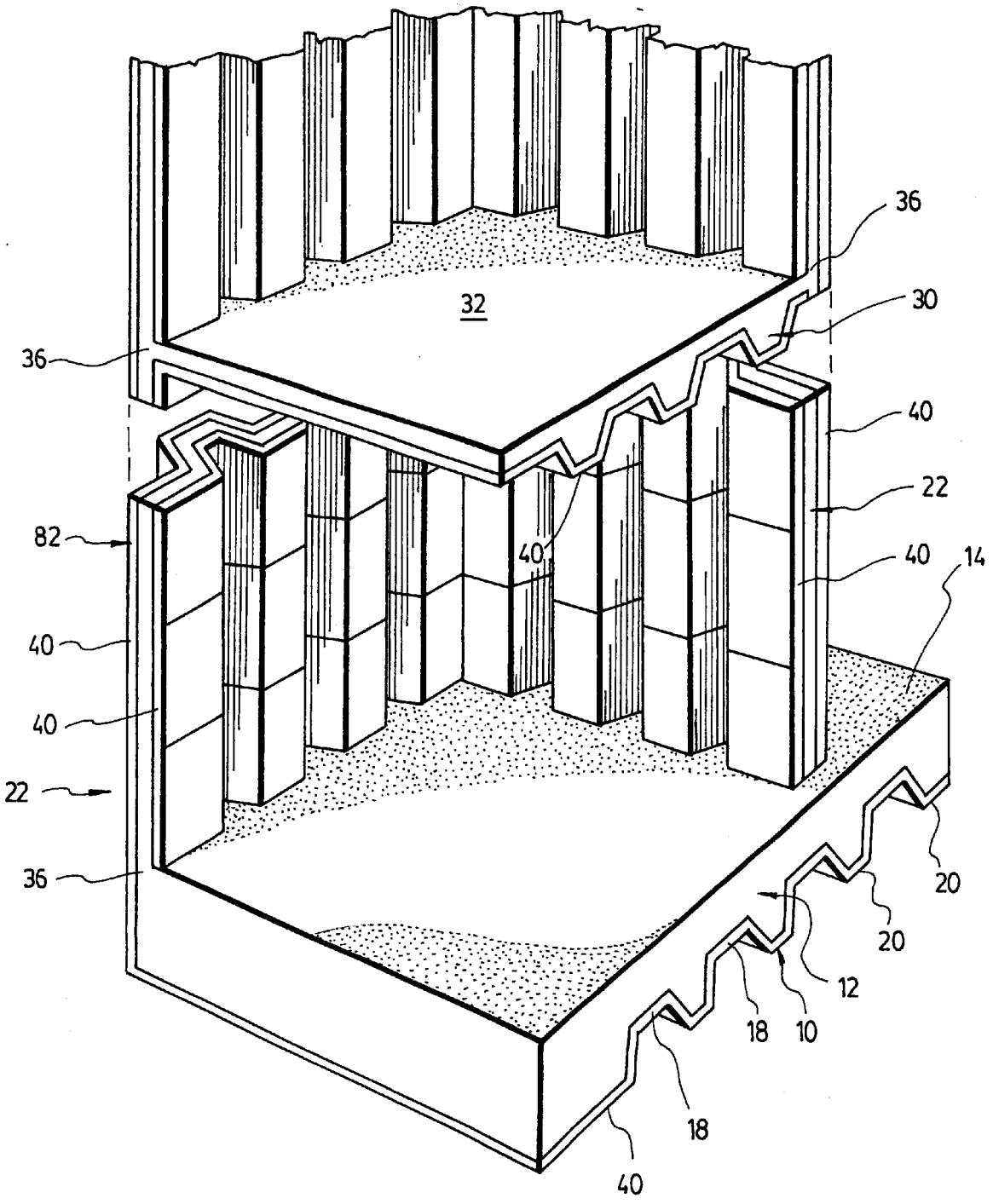

Referring to FIG. 1 and also to FIG. 7, the construction (10) comprises a bottom wall (12) which could be either the foundations, if the construction is a one storey building, or the floor of an overhead storey in a multi-storey construction. The bottom wall (12) is made of concrete. It has a planar top face (14) and an under face (16) with a generally corrugated relief with alternating recesses (18) and ridges (20) extending in a substantially horizontal direction.

The construction (10) also has a plurality of sidewalls (22) extending upright from the bottom wall (12). Each sidewall (22) is made of concrete and has a uniform thickness throughout. It also has a generally overall corrugated cross section with alternating recesses (18) and ridges (20) extending in a substantially vertical direction. Preferably, each of the recesses (18) and ridges (20) in the sidewalls (22) has a semi hexagonal shape defined by two tapering wall sections and a third wall section interconnecting a thinner end of the two tapering wall sections.

A top wall (30) is intersecting the sidewalls (22) at upper edges thereof. The top wall (30) is also made of concrete and it has a top face (32) generally parallel to an under face (34), the under face having a generally corrugated relief with alternating recesses (18) and ridges (20) extending in a substantially horizontal direction.

The corners (36) formed at each intersection of the bottom wall (12) with the sidewalls (22) and at each intersection of the top wall (30) with the sidewalls (22) are monolithic. That is to say that the concrete of the sidewalls and the concrete of the top or bottom wall forms a solid uniform link.

Also preferably, each of the recesses (18) and ridges (20) in the bottom wall (12) and the top wall (30) has a semi hexagonal shape defined by two tapering wall sections and a third wall section interconnecting a thinner end of said two tapering wall sections.

As shown in FIG. 7, each of the sidewalls (22) has an inside face opposite an outside face both covered with an insulating foam panel (40). An insulating foam panel (40) is also covering the under face of each of the top wall (30) and the bottom wall (12). Those foam panels (40), which have a shape conforming the outline of the surface they are covering, are actually the forms that have been used to build the construction as will be described hereafter.

In greater detail, the system of the present invention provides a concrete construction having its sidewalls, top wall and bottom wall with a corrugated relief. The overall structure is such that a minimum amount of material (concrete) is used for a wall of a given strength. The recesses formed in the wall may have different configurations. A preferred configuration according to the present invention would be a semi hexagonal configuration wherein each recess is defined by two inwardly angled walls and a third wall interconnecting the inwardly angled walls, the third wall being generally parallel to the longitudinal axis of the wall. Although this configuration is preferred for simplicity of construction, it will be understood that other recess configurations such as hemispherical, rectangular, triangular, etc., may be used. It is important that the length of the inwardly extending recesses be proportional to the straight sections to permit transfer of a compression movement on the straight section to a tension movement.

Figure 9:
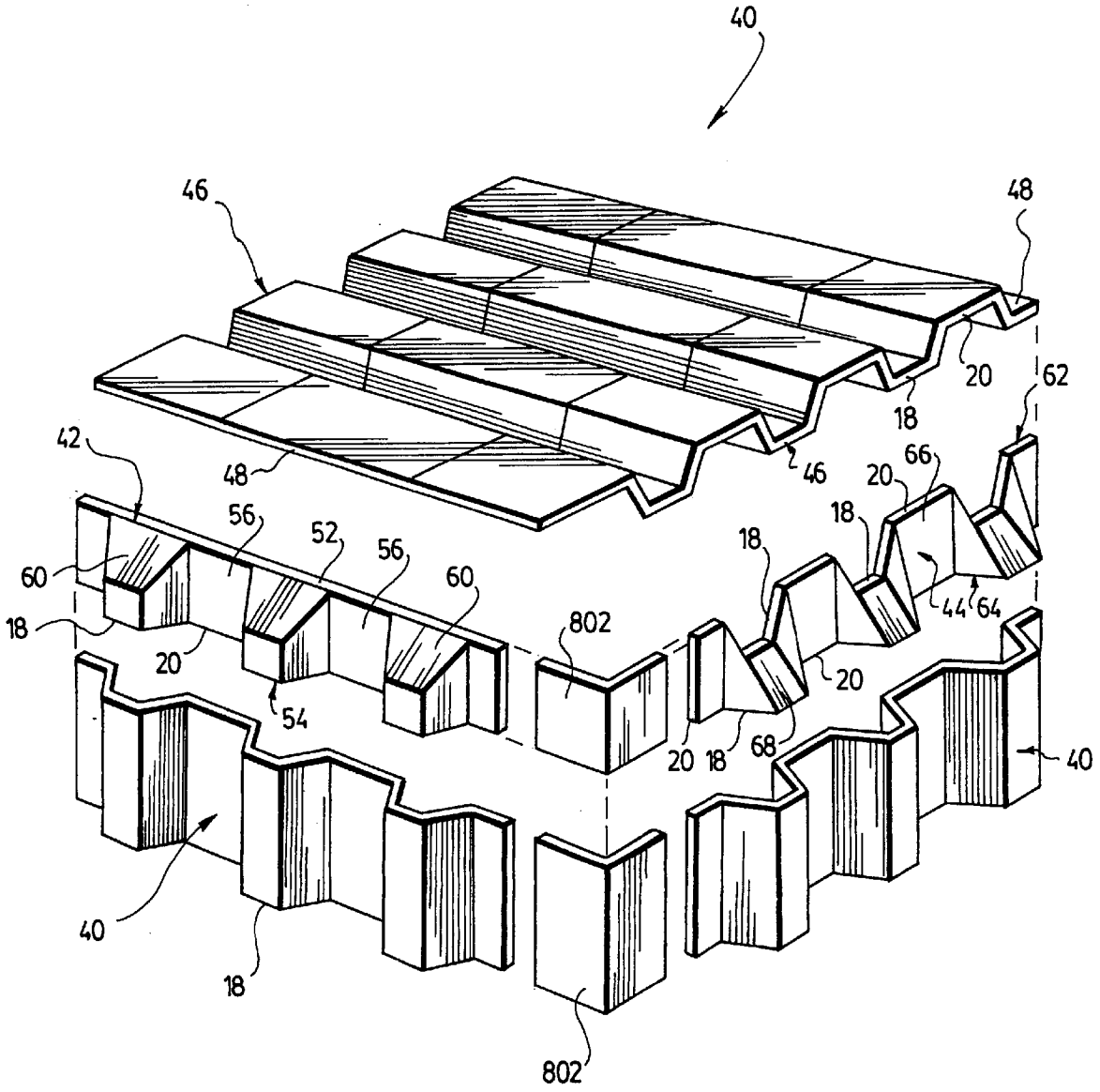
FIG. 9 is a perspective view of a kit of foam panels used to make a construction according to the invention.

Method of Making a Concrete Construction According to a Preferred Embodiment of the Invention The present invention also relates to a method of making a concrete construction as described above. FIGS. 4 to 7 show the different steps of that method performed on the site of construction and FIG. 9 shows the different modular foam panels used to build that construction. Reference will be made to FIGS. 4 to 7 and 9. The method generally comprises the steps of: a) providing a set of modular foam panels suitable to build the construction; b) preparing concrete beams that will be used later on to construct a top wall of the construction; c) erecting the sidewalls of the construction; and d) making a top wall of the construction.

a) Providing a Set of Foam Panels

FIG. 9 illustrates a set of modular foam panels suitable to build the construction. It will be understood that the use of the term "panels" throughout can include either monolithic elements or a panel built up of smaller members.

It is within the scope of the present invention to use any suitable material for the panels including, for example, wood, metal, and plastic. A preferred material would be any of the known structural form materials, most preferably insulating foam panel. This set comprises a plurality of corrugated foam panels (40); at least two corner foam panels of a first type (42) and at least two corner foam panels of a second type (44). As can be appreciated, all of these panels are modular panels having in common at least one matching corrugated edge with alternating recesses (18) and ridges (20) which make it easy to assemble the panels. The recesses (18) and the ridges (20) preferably have a semi hexagonal shape and the recesses (18) are preferably half the length of the ridges (20) so it makes it possible to obtain a concrete form for the sidewalls which defines a wave shape with a constant wavelength and a distance between two peaks that preferably equals the width of a conventional wall.

More particularly, each of the corrugated foam panels (40) has a generally rectangular shape outlined by a first pair of opposite corrugated side edges (46) and a second pair of opposite linear side edges (48). Each of the corrugated foam panels (40) has a generally corrugated relief with alternating recesses (18) and ridges (20) extending in a longitudinal direction between the two corrugated side edges (46,48). The recesses (18) and the ridges (20) have a semi hexagonal shape with two tapering segments and a third segment interconnecting a thinner end of the two tapering segments.

Each of the corner foam panels of the first type (42) includes a linear first edge (52) opposite a corrugated second edge (54) with alternating recesses (18) and ridges (20) matching the corrugated side edges of the corrugated foam panels (40). The linear first edge (52) and the corrugated second edge (54) extend in substantially parallel planes. The recesses (18) have a semi hexagonal shape with two tapering segments and a third segment interconnecting a thinner end of the two tapering segments. A substantially planar wall section (56) extends perpendicularly to these parallel planes of the first and second edges (52,54) between each ridge (20) of the second edge (54) and a segment of the first edge (52) and polyhedron wall section (60) extends between the recesses (18) of the second edge (54) and segments of the first edge (54).

The corner foam panels of the second type (44) include a corrugated first edge (62) matching with the corrugated side edges (46) of the corrugated foam panel (40) and having alternating recesses (18) and ridges (20) extending in a first plane. The recesses (18) have a semi hexagonal shape with two tapering segments and a third segment interconnecting a thinner end of the two tapering segments. The corner foam panels of the second type (44) further include a corrugated second edge (64) having alternating recesses (18) and ridges (20) matching with the corrugated side edges (46) of the corrugated foam panel (40) and extending in a second plane substantially perpendicular to the first plane. As with the recesses (18) of the first edge (62), the recesses (18) of the second edge (64) have a semi hexagonal shape defined by two tapering segments and a third segment interconnecting a thinner end of the two tapering segments. Substantially planar wall sections (66) extend in the first plane between the ridges (20) of the first and second edge (62, 64); and polyhedron wall sections (68) extend between the recesses (18) of the first and second edge (62, 64).

It also preferably comprises planar foam panels and another type of corner panel forms (802).

b) Preparing the Concrete Beams

Figure 4:
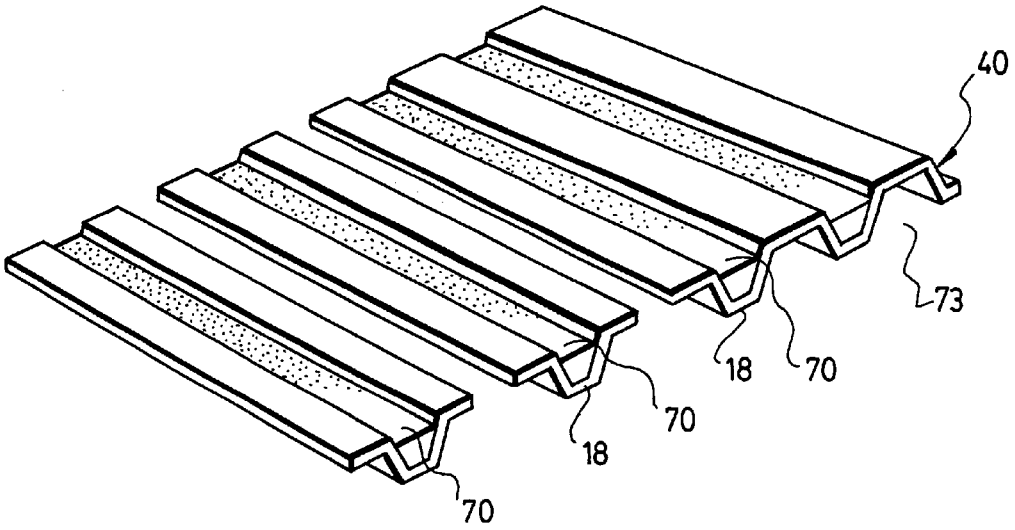
FIGS. 4 to 7 are schematic perspective views of the different steps on the building site for making the construction shown in FIG. 1.

Referring to FIG. 4, the concrete beams (70) that will be used later on to construct the top wall of the construction are then prepared. This step comprises setting one of the corrugated foam panel (40) on a planar surface (73) with its longitudinal direction extending parallel to the planar surface and pouring a concrete slurry only in the recesses (18) of the corrugated foam panel (40) so to form a plurality of parallel concrete beams (70).

c) Preparing the Foundations and Erecting the Sidewalls of the Construction

Then, substantially in concomitance with the preparation of the concrete beams (70), the sidewalls (22) of the construction are erected. The sidewalls (22) can be erected on an existing concrete foundation, or the method according to a preferred version of the invention illustrated in FIGS. 4 to 7 includes, prior to erecting the sidewalls (22), a step of making the foundations (72) of the construction (10).

Figure 5:
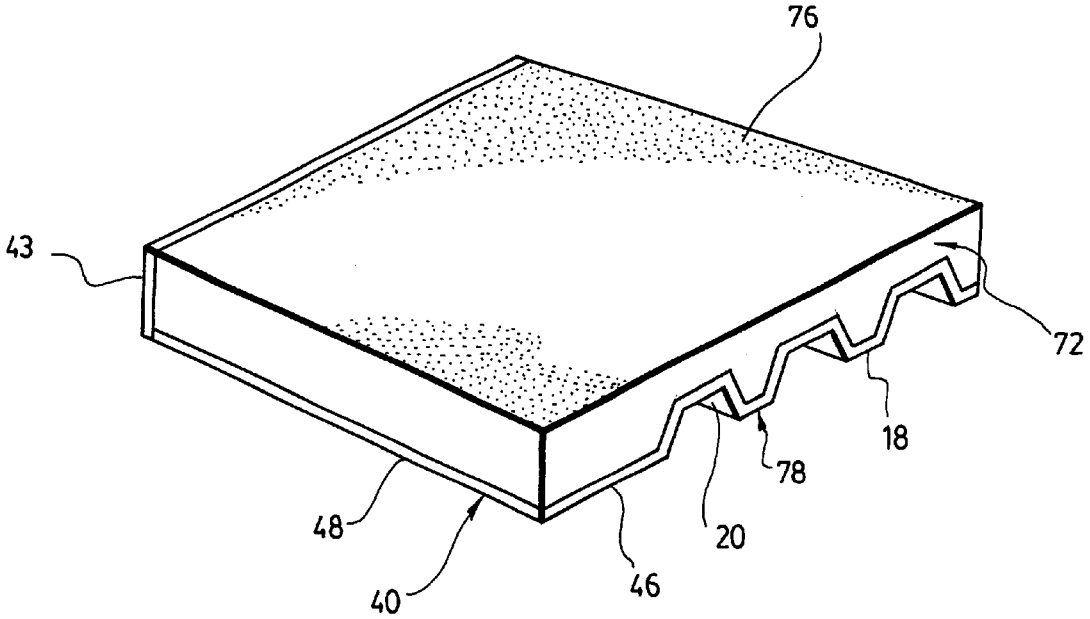
Figure 6:
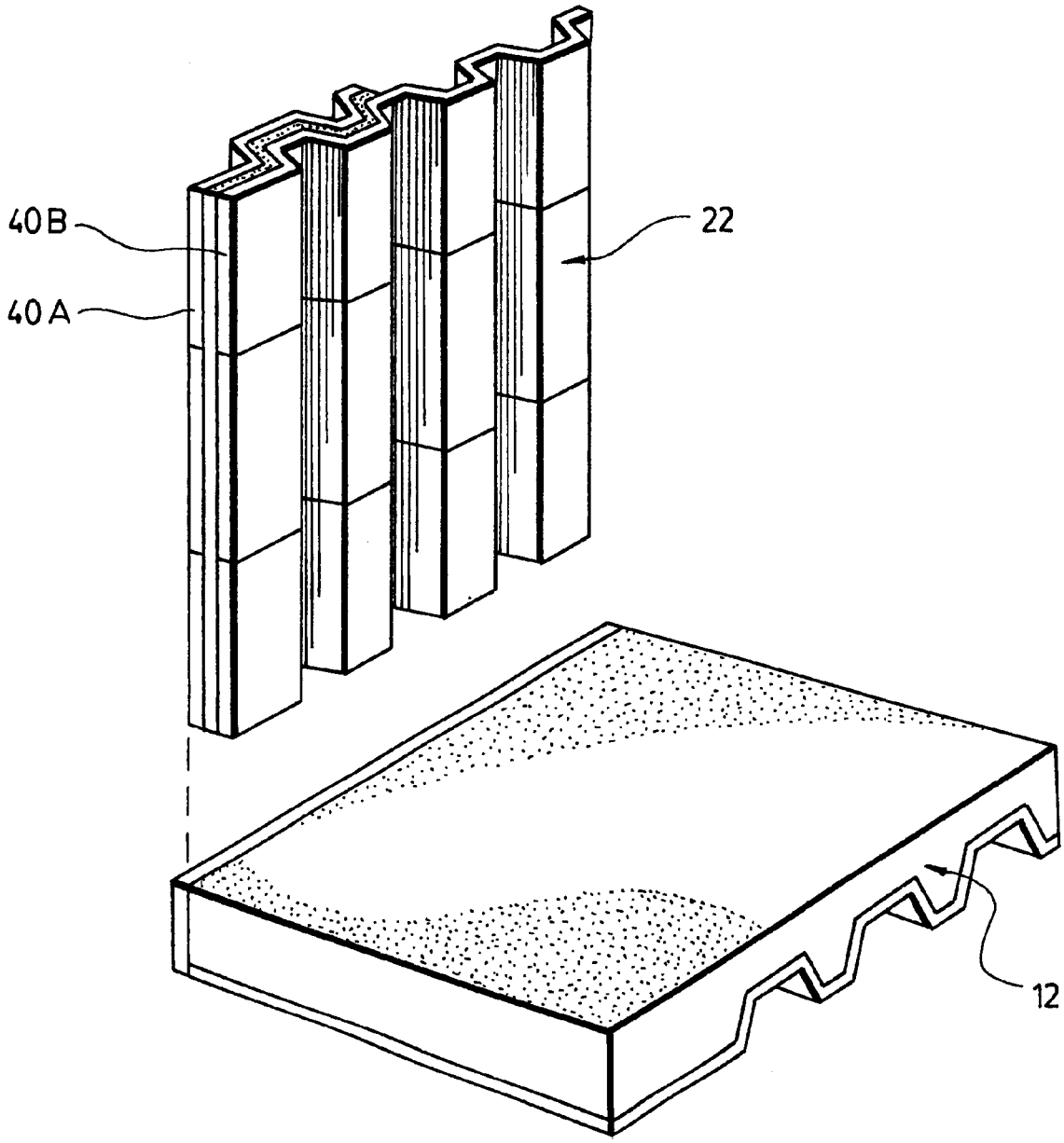

Referring to FIG. 5, the foundations (72) are made by setting on the ground a corrugated foam panel (40) with its longitudinal direction extending parallel to the ground and by bordering the side edges (46,48) thereof with a planar foam panel (43). Then, a concrete slurry (76) is poured on the corrugated foam panel (40) such that the recesses (18) and the ridges (20) thereof be completely covered with the slurry. As can be appreciated, the foundations (72) obtained thus have a planar top face (76) and a corrugated under face (78).

Figure 8:
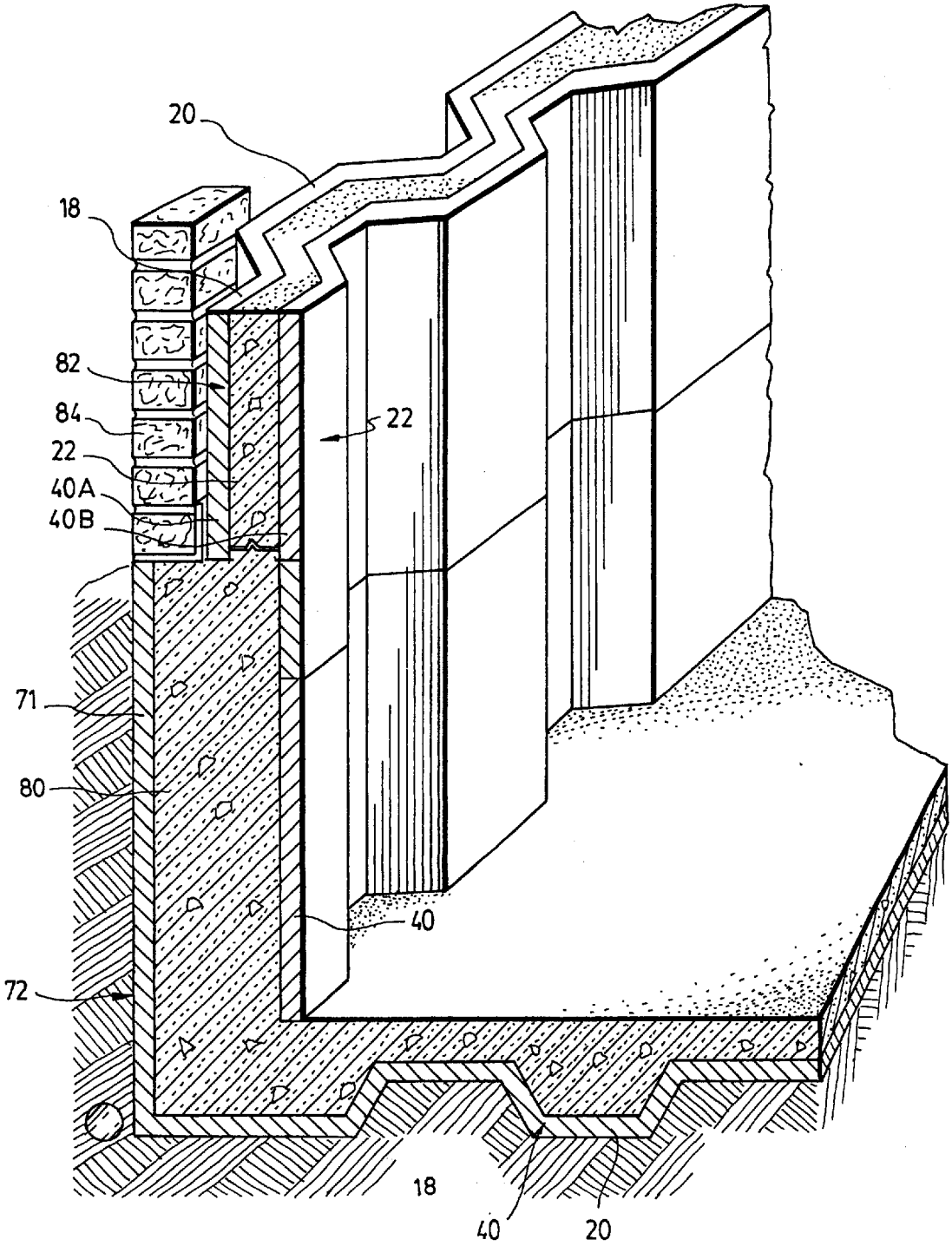
FIG. 8 is an enlarged view of the encircled area B in FIG. 7 showing in more details the making of the foundations.

Turning now to FIG. 8, the sidewalls (80) of the foundations (72) are erected. In order to build those sidewalls (80), a form is set along each side edge of the foundations (72). These forms are preferably disposed to form a rectangular construction including two pairs of opposites sidewalls. Each of the forms used comprises a planar foam panel (71) facing a corrugated foam (40) as described above, and defining therebetween a cavity. A concrete slurry is then poured in the cavity to form the sidewalls (80) of the foundations (72).

The sidewalls (22) of the construction (10) can then be erected by setting on top of each of the sidewalls (80) of the foundations (72) just formed, a wall form (82) comprising a pair of corrugated foam panels (40) with their longitudinal direction set to extend in a substantially vertical direction. The pair of panels (40) defines a cavity therebetween with a corrugated configuration, one of the corrugated foam panels being designated as an outside foam panel (40*a*) and the other one being designated as an inside foam panel (40*b*). The inside foam panel (40*b*) is preferably set directly on top of the corrugated foam panel (40) of the foundation sidewalls (80), as shown in FIG. 8, and the outside foam panel (40*a*) is set along the side edge of the foundation sidewalls (80) in such a way that the ridges (20) of the outside foam panel (40*a*) run along the side edge of the foundations and the recesses (18) come inwards of the construction, thereby leaving a space to build the finished outside wall (84) of the construction, such as a brick wall.

Once the wall forms (82) are installed, a concrete slurry (76) is poured in the cavities so to form the sidewalls (22). Then, in order to increase the height of the sidewalls (22), a similar wall form (82) is set on top of each wall form and a concrete slurry is poured therein.

d) Making a Top Wall of the Construction

While the concrete slurry poured in the above wall forms (82) is not completely solidified, the construction of the top wall (30) starts. To do so, a corner form of a first type for forming a corner (36) between a sidewall (22) and the top wall (30) is set on top of two of the wall forms (82) set in step c) and which are opposite each other. The comer form of the first type includes a corrugated foam panel (40) facing a corner foam panel of the first type (42) to define a cavity therebetween. The corrugated foam panel (40) is set on top of the outside corrugated foam panel (40*a*) set in step c) and the corner foam panel (42) is set on top of the inside corrugated foam panel (40*b*) set in step c) with its corrugated second edge (54) facing downwards, as shown in FIG. 9.

Figure 10:
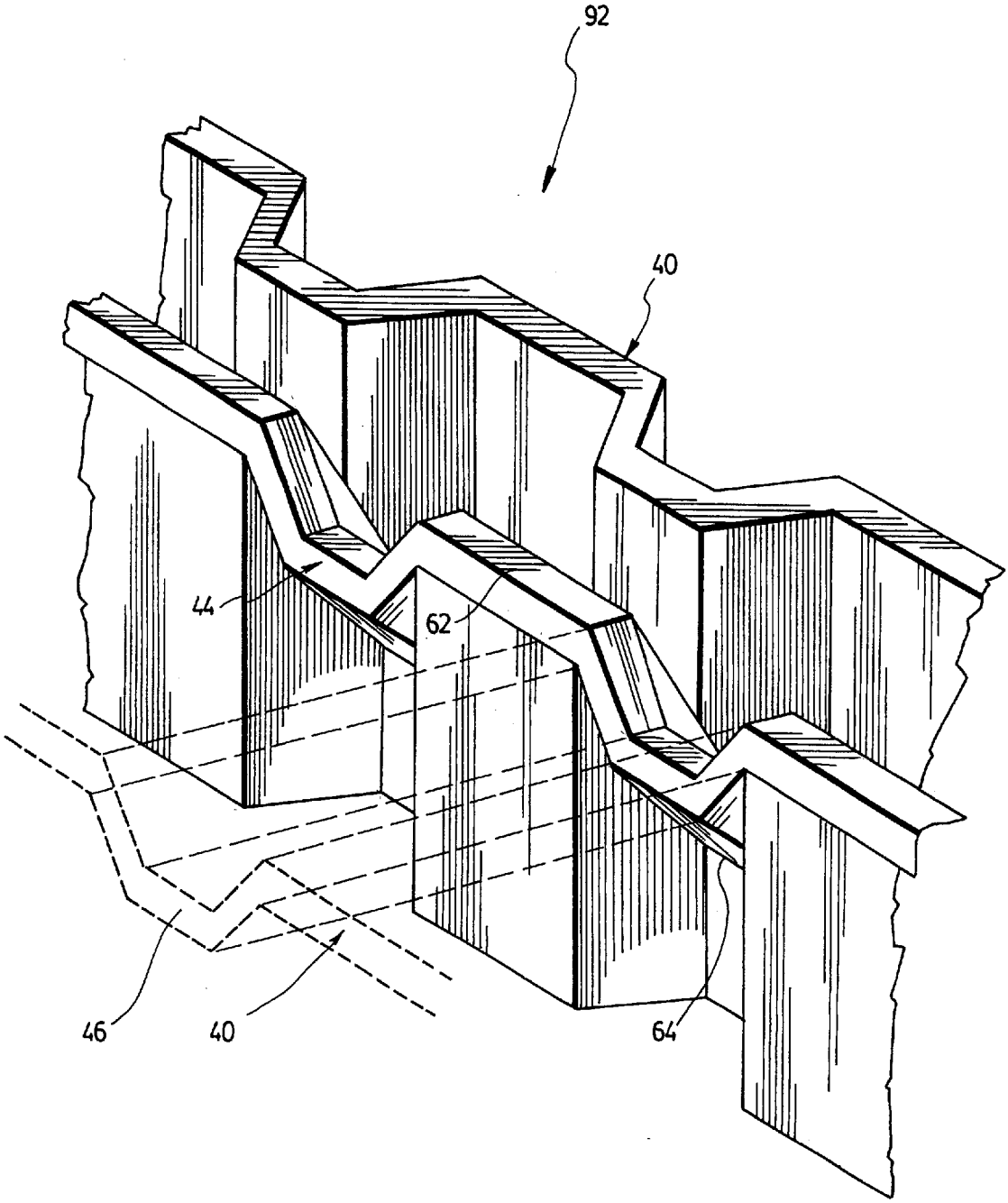
FIG. 10 is an enlarged perspective view of an assembly of foam panels used to make the top wall of the construction shown in FIG. 1.

Then, a corner form (92) of a second type is set on top of each of the other two wall forms (82) set in step c). Referring to FIG. 10, this corner form (92) includes a corrugated foam panel (40) facing a corner foam panel of the second type (44) to define a cavity therebetween. The corrugated foam panel (40) of the corner form (92) is set on top of the outside corrugated foam panel (40*a*) and the corner foam panel of the second type (44) is set on top of the inside corrugated foam panel (40*b*) with its corrugated second edge (64) facing downwards, as shown in FIG. 9.

The concrete beams (70) prepared earlier are then mounted over the corner form of the first type and of the second type (92) with the corrugated foam panel (40) supporting the beams (70). The beams (70) are set such that each of the two corrugated side edges (46) of the corrugated foam panel (40) bearing the beams (70) is laid down on the first edge (62) of a corresponding corner foam panel of the second type (44), as shown in FIG. 10, and that each of the two linear side edges (48) of the corrugated foam panel (40) is laid down on the linear first edge (52) of a corresponding corner foam panel of the first type (42).

A concrete slurry is poured in the cavity of each of the corner forms (92) and on the corrugated foam panel (40) supporting the beams (70) so to form a top wall (30) with a planar top face (37) opposite a corrugated under face (34) and monolithic concrete corners (36) between the sidewalls (22) and the top wall (30), as shown in FIG. 7.

A multi-storey construction can be built by setting, on the top face (32) of the top wall (30) just formed, wall forms (82) as defined in step c) for forming the sidewalls (22) of another storey of the construction, and then repeating the step of making a top wall (38).

Description of the Retaining Elements

There is also provided, with the set of foam panels described above, retaining elements, also called base elements, used to retain the foam panels in place. The retaining elements for the moulding of a concrete wall according to the present invention include bottom and top elements adapted to receive the form which would define the sidewall.

Figure 11:
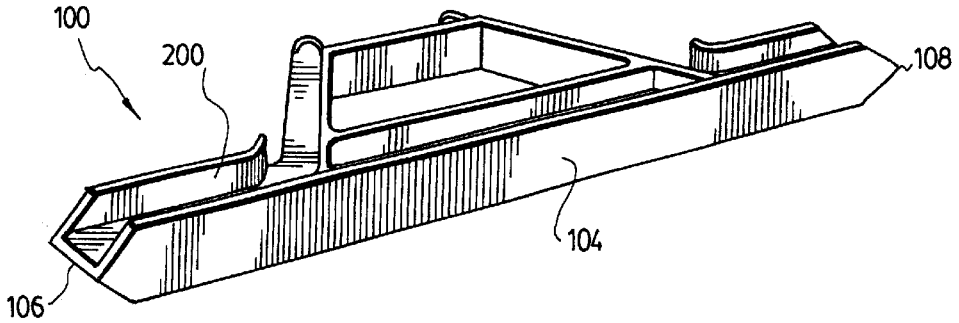
FIG. 11 is a perspective view of a sidewall base element.
Figure 12:
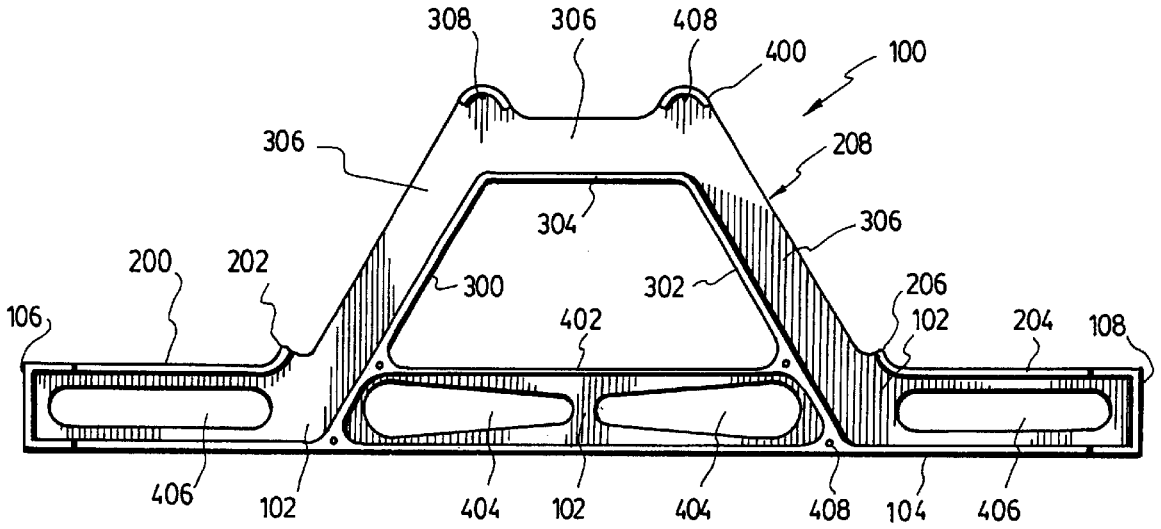
FIG. 12 is a top plan view thereof.
Figure 13:
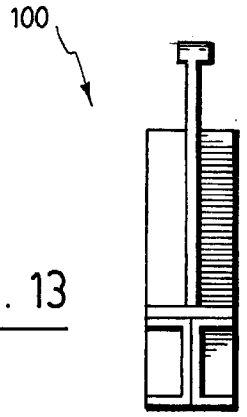
FIG. 13 is a side elevational view thereof as seen from the left hand side of FIG. 12.
Figure 17:
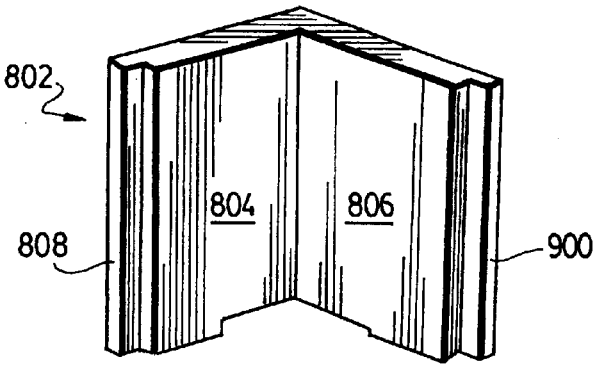
FIG. 17 is a perspective view of a comer panel form.
Figure 18:
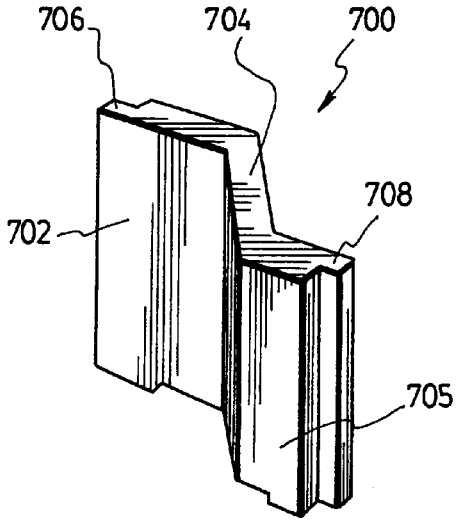
FIG. 18 is a perspective view of a sidewall panel section used to construct a main panel form.

Referring to FIGS. 11 to 21 in greater detail and by reference characters thereto, reference will initially be made to FIGS. 11, 12, and 13, which illustrate a sidewall base element generally designated by reference numeral (100).

Sidewall base element (100) includes a generally longitudinally extending portion having a base or bottom wall (102) with an exterior sidewall (104) extending along one marginal edge thereof. At either end of exterior sidewall (104), there are tips (106,108). Extending parallel to exterior sidewall (104) and inwardly from tip (106) is a first interior wall portion (200). As may be best seen in FIGS. 11 and 12, interior wall portion (200) terminates in an arcuate wall section (202). A second interior wall section (204) extends inwardly from tip (108) and is also parallel to exterior sidewall (104). It too terminates in an arcuate wall section (206).

Sidewall base element (100) also includes an inset section generally designated by reference numeral (208). Inset section (208) is defined by a first inwardly extending wall (300), a second inwardly extending wall (302), and a horizontally extending wall (304) interconnecting inwardly extending walls (300) and (302). A base or bottom wall (306) is provided at walls (306), (302) and (304).

As seen in FIG. 12, a pair of arcuate wall sections (308) and (400) extends upwardly from bottom portion (306) opposite horizontally extending wall (304).

Preferably, walls (300,302) are from between one half to twice the length of wall (304). Walls (200) and (204) are likewise one half to four times the length of wall (304).

A reinforcing wall section (402) extends between inwardly extending walls (300,302) and which reinforcing wall (402) is parallel to exterior sidewall (104).

As may be seen in FIG. 12, bottom portion or wall (102) has a plurality of generally oblong apertures (404) formed therein.

There is also provided a plurality of relatively small apertures (408) at various locations in element (100) for purposes which will become apparent hereinbelow.

FIGS. 14, 15 and 16 illustrate a corner base element which is generally designated by reference numeral (500) and reference will now be made thereto. Corner base element (500) includes a pair of mutually perpendicular exterior sidewalls (502,504) and a pair of tips (506,508). Mutually perpendicular interior sidewalls (600,602) are parallel to exterior walls (502,504), respectively. A bottom wall or base (604) has a plurality of relatively large apertures (606) formed therein as well as a plurality of relatively small apertures (608) located adjacent to the sidewalls.

The form system of the present invention includes a panel assembly for the bottom wall, the top wall, the horizontal corners, the sidewalls and the vertical corners. Thus, as may be seen in FIGS. 17 to 20, the corrugated foam panels (40) described hereinbefore are preferably formed with a modular sidewall panel (700) including a first wall section (702), a second wall section (704), and a third wall section (705). First and third wall sections (702,705) are parallel with respect to each other and second wall section (704) extends between first wall section (702) and third wall section (705) to form an angle of generally between 15° and 25°. As may be seen, first wall section (702) has a flange (706) extending outwardly therefrom and third wall section (705) has a corresponding flange (708) extending outwardly therefrom.

Figure 19:
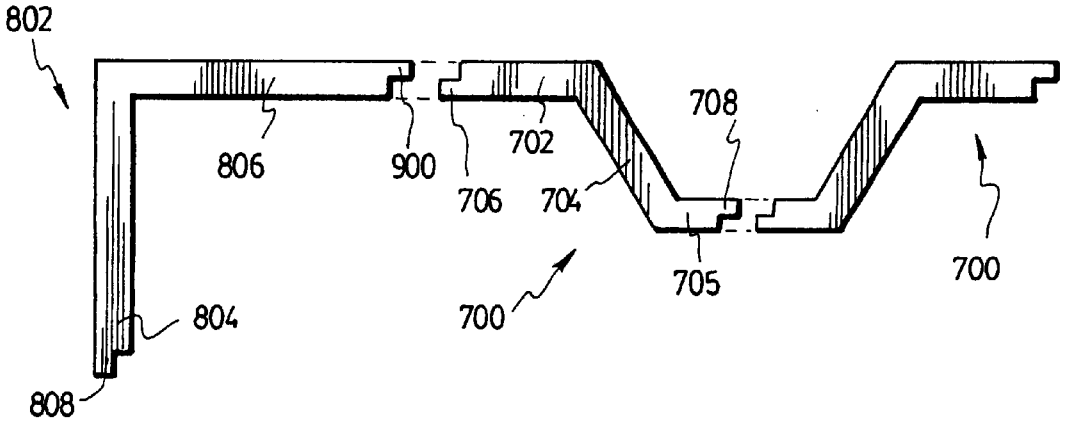
FIG. 19 is a top plan view illustrating the assembly of the panel forms according to the present invention.
Figure 21:
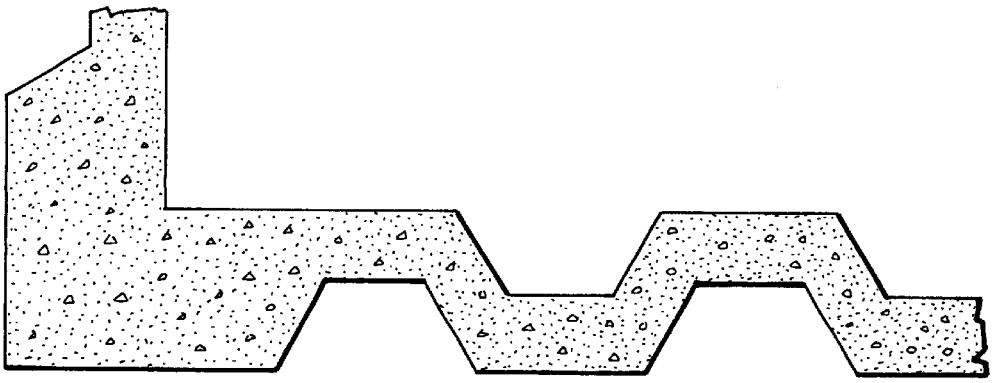
FIG. 21 is a top plan view of a portion of a concrete wall resulting from the use of the form system of the present invention.

A corner panel shown in FIGS. 19 and 21 is generally designated by reference numeral (802) and includes a first wall section (804) and a second wall section (806) which are mutually perpendicular. Wall sections (804,806) have flanges (900) and (808) associated therewith.

Figure 20:
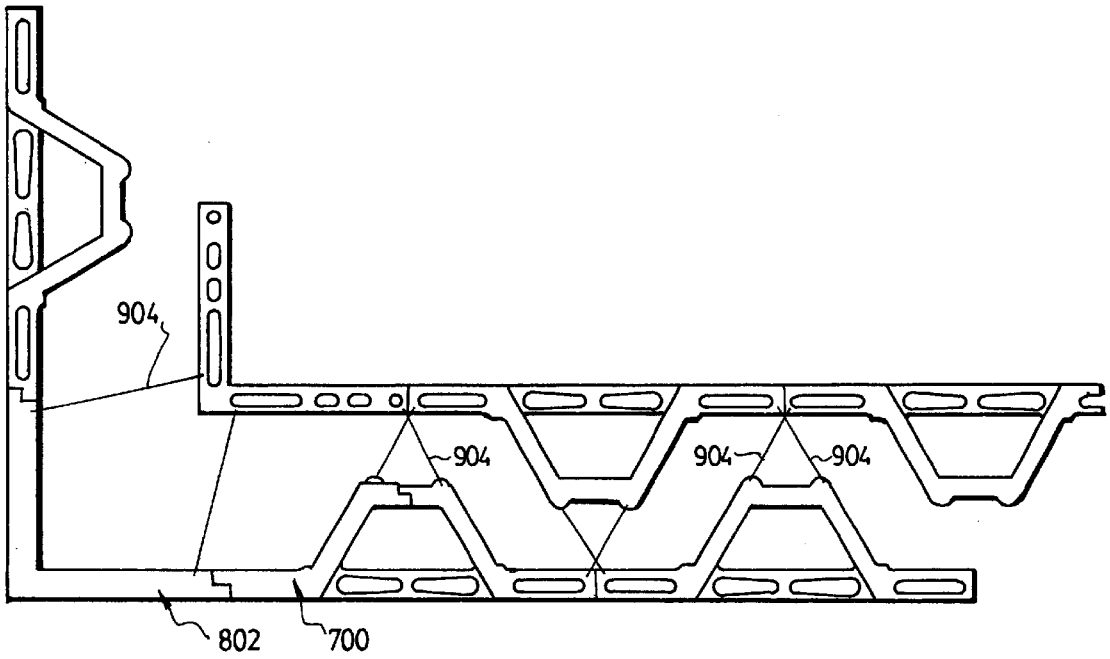
FIG. 20 is a top plan view, partially in a section, of the concrete form system of the present invention.

In use, and as may be best seen in FIG. 20, a plurality of sidewall base elements (100) is placed in an opposing relationship to define a sidewall which will have a semi hexagonal insert. Sidewall base elements (100) are secured together by means of connecting wires (904) which extend through apertures (408) in elements (100), and apertures (608) in corner elements (500). The connecting wires (904) preferably consist of two independent crossed wires free to move independently from each other. As will be noted, the connecting together by connectors in (904) is such that the sidewall base elements (100) and corner elements (500) are held in a state of tension, while the concrete is poured in the cavity, thereby forcing the panels to come together and preventing water in the unsolidified concrete from leaking.

Subsequent to the placement of elements (100) and (500), sidewall panel forms (700) and corner panel forms (802) are placed within the elements and corresponding elements (100,102) are secured on the upper portion thereof. There is thus provided a form system which is light weight and easy to use.

In practice, one would construct the forms using a plurality of intermediate elements between the top and bottom elements. These elements would include the same feature, being adapted to receive a panel form in either side thereof.

Subsequent to the pouring of the concrete, the wall will have a sectional configuration, as shown in FIG. 21, wherein semi hexagonal recesses are provided in the wall. This permits the use of less concrete while the corrugated configuration assures that there is no loss of strength.

It will be understood that the above-described embodiment is for purposes of illustration only and that changes and modifications may be made thereto without departing from the spirit and scope of the invention.

For the sake of simplicity, reference has been made to a bottom element and a top element with a panel extending therebetween. In practice, most walls would use a plurality of such elements in a vertical relationship to each other. In practice, the height of each panel extending between two of the panel retaining elements could vary between 15 to 60 centimeters with the prime determination being the strength of the material forming the panels.

The construction according to the present invention is also interesting in that it provides for an adjustable thin and rigid section, using high performance materials. The tests performed on a preferred embodiment of the invention showed that the replacement of the conventional steel framework with a dispersed particles framework made of steel particles, polymer or carbon fibres, improves greatly the strength of the concrete structure.

A preferred embodiment of the present invention uses a high performance concrete to which is added metallic fibres, more specifically fibres having a particular shape designed by the inventor, and unique superplastifier additives. Such high performance concrete can be poured in relatively small spaces. These additives also make it possible to increase the resistance of the concrete in compression, flexion and tension. Such high performance concrete also has a capacity of absorption which is 10 to 15 times higher that traditional concrete, in the case where the structure is subject to earthquakes.

This light structure, which is entirely made of concrete reinforced with dispersed fibres, and which has a high absorption capacity combined with a high moment of inertia, allows the surcharges to be uniformly distributed throughout the structure. Therefore, a concrete structure according to the invention is able to sustain an omnidirectional charge and is thus able to better resist to earthquake charges and raging winds.

Advantageously, a construction according to the invention may use the principles related to the so-called "floating foundation", meaning that the weight of the structure is maintained equal to the volume of soil displaced, thereby eliminating the stresses related to compression, to subsidence and further packing down of the soil. A construction according to the invention thus shows a very good resistance to underquakes.

Certain embodiments of the present invention present, among others, the following advantages:

an optimal construction having forms and sections perfectly adapted to the charges;

reduction and even elimination of thermal bridges throughout the construction and thermal build up inside the mass;

an important reduction in the production cost of the construction as it uses 40% less material than conventional concrete structure;

easiness and rapidity of erection of the construction, the present invention makes it possible to build a house with a minimum equipment and staff;

ecological and recyclable material;

fireproof and non-combustible construction; and soundproof.

Although a preferred embodiment of the present invention has been described in detail herein and illustrated in the accompanying drawings, it is to be understood that the invention is not limited to this precise embodiment and that various changes and modifications may be effected therein without departing from the scope or spirit of the present invention.

What is claimed is:

1. A concrete construction comprising:

a monolithic construction of concrete reinforced with dispersed metal fibers and having a bottom wall with a top face generally parallel to an under face, the under face having a generally corrugated relief with alternating recesses and ridges extending in a substantially horizontal direction;

a plurality of sidewalls extending upwardly from the bottom wall, each sidewall having a generally overall corrugated cross section with alternating recesses and ridges extending in a substantially vertical direction; and a top wall intersecting the sidewalls at upper ends thereof, the top wall having a top face generally parallel to an under face, the under face having a generally corrugated relief with alternating recesses and ridges extending in a substantially horizontal direction; and an insulating foam panel covering the under face of each of the top wall and the bottom wall and a set of insulating foam panels sandwiching each of the sidewalls, said insulating foam panels being the concrete formwork of the concrete structure.

2. A concrete construction as claimed in claim 1, comprising a monolithic corner formed at each intersection of the bottom wall with the sidewalls and at each intersection of the top wall with the sidewalls.

3. A concrete construction as claimed in claim 1, wherein each of the sidewalls has a uniform thickness throughout.

4. A concrete construction as claimed in claim 1, wherein each of said recesses and ridges in the sidewalls has a semi hexagonal shape.

5. A concrete construction as claim in claim 4, wherein each of the recesses and ridges in the bottom wall and the top wall has a semi hexagonal shape.

6. A method of making a monolithic concrete construction having:

a bottom wall with a top face generally parallel to an under face, the under face having a generally corrugated relief with alternating recesses and ridges extending in a substantially horizontal direction;

a plurality of sidewalls extending upwardly from the bottom wall, each sidewall having a generally overall corrugated cross section with alternating recesses and ridges extending in a substantially vertical direction; and a top wall intersecting the sidewalls at upper ends thereof, the top wall having a top face generally parallel to an under face, the under face having a generally corrugated relief with alternating recesses and ridges extending in a substantially horizontal direction;

the method comprising the steps of:

a) providing a set of foam panels including:

a plurality of corrugated foam panels having a generally rectangular shape outlined by a first pair of opposite corrugated side edges and a second pair of opposite linear side edges and a generally corrugated relief with alternating recesses and ridges extending in a longitudinal direction between the two corrugated side edges, said recesses and ridges having a semi hexagonal shape;

at least two corner foam panels of a first type including:

a linear first edge opposite a corrugated second edge with alternating recesses and ridges matching the corrugated side edges of the corrugated foam panels, the linear first edge and the corrugated second edge extending in substantially parallel planes, said recesses and ridges having a semi hexagonal shape;

substantially planar wall sections extending perpendicularly to said parallel planes of the first and second edges between the ridges of the second edge and segments of the first edge; and polyhedron wall sections extending between the recesses of the second edge and segments of the first edge; and at least two corner foam panels of a second type including:

a corrugated first edge matching with the corrugated side edges of the corrugated foam panel and having alternating recesses and ridges extending in a first plane, the recesses and ridges having a semi hexagonal shape;

a corrugated second edge having alternating recesses and ridges matching with the corrugated side edges of the corrugated foam panel and extending in a second plane substantially perpendicular to said first plane, the recesses and ridges having a semi hexagonal shape;

substantially planar wall sections extending in said first plane between the ridges of the first and second edge; and polyhedron wall sections extending between the recesses of the first and second edge;

b) preparing concrete beams that will be used later on to construct a top wall of the construction, comprising setting one of the corrugated foam panels on a planar surface with said longitudinal direction extending parallel to said planar surface and pouring a concrete slurry only in the recesses of said corrugated foam panel so to form a plurality of parallel concrete beams;

c) erecting the sidewalls of the construction comprising the steps of:

setting, on a concrete foundation, wall forms for forming the sidewalls of the construction, each of the wall forms comprising a pair of said corrugated foam panels with said longitudinal direction set to extend, in a substantially vertical direction, said pair of panels defining a cavity therebetween with a corrugated configuration, one of said corrugated foam panels being designated as an outside foam panel and the other one being designated as an inside foam panel, said form walls being disposed to form a rectangular construction including two pairs of opposite sidewalls;

pouring a concrete slurry in the cavity of each wall form; and d) while the concrete slurry poured in step c) is not completely solidified, making a top wall of the construction, comprising:

setting on top of two of said wall forms set in step c), and which are opposite to each other, a corner form for forming a corner between a sidewall and the top wall, the corner form including a corrugated foam panel facing a corner foam panel of the first type to define a cavity therebetween, the corrugated foam panel being set on top of the outside corrugated foam panel set in step c) and the corner foam panel being set on top of the inside corrugated foam panel set in step c) with its corrugated second edge facing downwards;

setting on each of the other two walls forms set in step c) a corner form including a corrugated foam panel facing a corner foam panel of the second type to define a cavity therebetween, the corrugated foam panel of the corner form being set on top of the outside corrugated foam panel set in step c) and the corner foam panel of the second type being set on top of the inside corrugated foam panel with its corrugated second edge facing downwards;

mounting, over said corner forms, the concrete beams with the corrugated foam panel prepared in step b) such that each of the two corrugated side edges of said corrugated foam panel bearing the beams is laid down on the first edge of a corresponding corner foam panel of the second type and that each of the two linear side edges of said corrugated foam panel is laid down on the linear first edge of a corresponding corner foam panel of the first type; and pouring a concrete slurry in the cavity of each of the corner forms and on the corrugated foam panel of step b) so to form a top wall with a planar to face opposite a corrugated under face and monolithic concrete corners between the sidewalls and the top wall.

7. A method according to claim 6, further comprising, before or at the same time of step b), a step of making the foundations of the construction, comprising the sub-steps of:

setting on the ground a corrugated foam panel with its longitudinal direction extending parallel to the ground and bordering the side edges thereof with a planar foam panel; and pouring a concrete slurry on said corrugated foam panel that the recesses and ridges thereof be completely covered with the slurry, thereby providing the foundations with a planar top face and a corrugated under face.

8. A method according to claim 7, further comprising, after step d), the steps of:

e) setting, on the top face of the top wall formed in step d)t wall forms as defined in step c) for forming the sidewalls of another storey of the construction; and f) pouring a concrete slurry in the cavity of each wall form; and repeating steps d), e) and f) so to make a multi-storey construction.

9. A method according to claim 7 comprising, after step c), a step of:

setting, on top of each wall form set in step c), a similar wall form so to increase the height of the sidewalls of the construction.

10. A corner foam panel for forming with a planar foam panel a corner in a concrete construction, the corner foam panel comprising:

a linear first edge opposite a corrugated second edge with alternating recesses and ridges, the linear first edge and the corrugated second edge extending in substantially parallel planes, said recesses and ridges having a semi hexagonal shape;

substantially planar wall sections extending perpendicularly to said planes of the first and second edge between the ridges of the second edge and segments of the first edge; and polyhedron wall sections extending between the recesses of the second edge and segments of the first edge.

11. A corner foam panel for forming, with a planar foam panel, a corner in a concrete construction, the corner foam panel comprising:

a corrugated first edge having alternating recesses and ridges extending in a first plane, the recesses and ridges having a semi hexagonal shape;

a corrugated second edge having alternating recesses and ridges extending in a second plane substantially perpendicular to the first plane, the recesses and ridges having a semi hexagonal shape;

substantially planar wall sections extending in said first plane between the ridges of the first and second edge; and polyhedron wall sections extending between the recesses of the first and second edge.

12. A kit of modular foam panels used to make a monolithic concrete construction having:

a bottom wall with a top face generally parallel to an under face, the under face having a generally corrugated relief with alternating recesses and ridges extending in a substantially horizontal direction;

a plurality of sidewalls extending upwardly from the bottom wall, each sidewall having a generally overall corrugated cross section with alternating recesses and ridges extending in a substantially vertical direction; and a top wall intersecting the sidewalls at upper ends thereof, the top wall having a top face generally parallel to an under face, the under face having a generally corrugated relief with alternating recesses and ridges extending in a substantially horizontal direction; and a) a plurality of corrugated foam panels having a generally rectangular shape outlined by a first pair of opposite corrugated side edges and a second pair of opposite linear side edges and a generally corrugated relief with alternating recesses and ridges extending in a longitudinal direction between the two corrugated side edges, said recesses and ridges having a semi hexagonal shape;

b) at least two corner foam panels of a first type including:

a linear first edge opposite a corrugated second edge with alternating recesses and ridges matching the corrugated side edges of the corrugated foam panels, the linear first edge and the corrugated second edge extending in substantially parallel planes, said recesses and ridges having a semi hexagonal shape;

substantially planar wall sections extending perpendicularly to said parallel planes of the first and second edges between the ridges of the second edge and segments of the first edge; and polyhedron wall sections extending between the recesses of the second edge and segments of the first edge; and c) at least two corner foam panels of a second type including:

a corrugated first edge matching with the corrugated side edges of the corrugated foam panel and having alternating recesses and ridges extending in a first plane, the recesses and ridges having a semi hexagonal shape;

a corrugated second edge having alternating recesses and ridges matching with the corrugated side edges of the corrugated foam panel and extending in a second plane substantially perpendicular to said first plane, the recesses and ridges having a semi hexagonal shape;

substantially planar wall sections extending in said first plane between the ridges of the first and second edge; and polyhedron wall sections extending between the recesses of the first and second edge.

* * * * *